United States Patent [19]

Trogan

[11] Patent Number: 4,475,730

[45] Date of Patent: Oct. 9, 1984

[54] APPARATUS FOR FOLDING AND STACKING PAPER PRODUCTS

[75] Inventor: John F. Trogan, Ashland, Wis.

[73] Assignee: C.G. Bretting Mfg. Co., Inc., Ashland, Wis.

[21] Appl. No.: 477,898

[22] Filed: Mar. 23, 1983

[51] Int. Cl.[3] ..... B41L 43/04

[52] U.S. Cl. ..... 270/41

[58] Field of Search ..... 270/41–44, 270/32, 5, 6, 10, 20.1, 58

[56] References Cited

U.S. PATENT DOCUMENTS

| | | | |
|---|---|---|---|
| 1,992,179 | 2/1935 | Blosser et al. | 270/41 |
| 2,631,845 | 3/1953 | Zuckerman | 270/5 |
| 3,784,187 | 1/1974 | Takayanagi et al. | 270/6 |
| 3,834,689 | 9/1974 | Lee et al. | 270/41 |
| 3,948,504 | 4/1976 | Woessner et al. | 270/41 |
| 4,190,242 | 2/1980 | Bolza-Schunemann | 270/42 |
| 4,279,410 | 7/1981 | Bolza-Schunemann | 270/6 |
| 4,349,185 | 9/1982 | Small et al. | 270/32 |

FOREIGN PATENT DOCUMENTS

| | | | |
|---|---|---|---|
| 442935 | 4/1927 | Fed. Rep. of Germany | 270/41 |
| 719833 | 4/1942 | Fed. Rep. of Germany | 270/42 |
| 116974 | 8/1946 | Sweden | 270/41 |
| 321873 | 11/1929 | United Kingdom | 270/32 |

*Primary Examiner*—E. H. Eickholt

*Attorney, Agent, or Firm*—Sherman Levy

[57] ABSTRACT

A method and apparatus for continuously folding a plurality of webs of material such as paper or the like, cutting the webs into segments of predetermined length, combining the segments into a group and then stacking the groups together until a desired number of segments are present in the stack after which the stack is discharged while a new stack is being started.

7 Claims, 5 Drawing Figures

APPARATUS FOR FOLDING AND STACKING PAPER PRODUCTS

TECHNICAL FIELD

This invention relates generally to the method and apparatus for folding, cutting and stacking flexible products and relates particularly to the folding, cutting and stacking of paper products such as "C" fold facial tissues, paper napkins and the like in a high speed operation.

BACKGROUND ART

In the past, most "C" fold paper products such as facial tissue and the like have been folded, interleaved and stacked on multiple unwind machines which involved unwinding the same number of rolls of tissue or other material as the number of products in the individual box or container. For example, if a 200 count box of tissue was required, 200 rolls of tissue were unwound, folded and progressively placed on top of each other and were then cut to an appropriate size. This type of machine has a large, high speed output potential but requires many people to operate, a large capital investment, a large floor space requirement, and a logistics problem for mixing cases of product with different colored boxes or containers of finished product.

Some examples of this type of machine include U.S. Pat. No. 3,536,317 to Billett; U.S. Pat. No. 3,980,289 to Harin; and U.S. Pat. No. 4,290,592 to Kastner.

Other machines have been provided for stacking a plurality of articles in either vertical or horizontal stacks prior to or as a function of a packaging or boxing operation such as shown by U.S. Pat. Nos. 4,283,973 and 4,285,621 to Spencer, and U.S. Pat. No. 4,325,475 to Spalding.

DISCLOSURE OF THE INVENTION

The present invention is embodied in a method and apparatus for continuously folding a plurality of webs of porous paper or the like (preferably into a "C" shaped configuration), combining certain webs to form a first lane and other webs to form a second lane, cutting the webs of both lanes into segments of predetermined length, separating such segments longitudinally of each other, combining the web segments of the first lane with the web segments of the second lane to form a group of web segments, transferring the groups of segments to a packer roll, discharging the groups of segments on to a movable table to form a stack, and then discharging the stack from the table after a predetermined number of segments have been stacked while a new stack is begun in a continuous high speed operation.

It is an object of the invention to provide a method and apparatus for folding a plurality of webs of porous material such as facial tissue or the like, cutting such webs into segments of a desired length, combining such segments with other segments in alignment with each other, transferring such segments to a table to form a vertical stack, and removing such stack from the table when a predetermined number of segments have been accumulated in a continuous high speed operation.

DESCRIPTION OF THE PREFERRED EMBODIMENT

Figure 1:
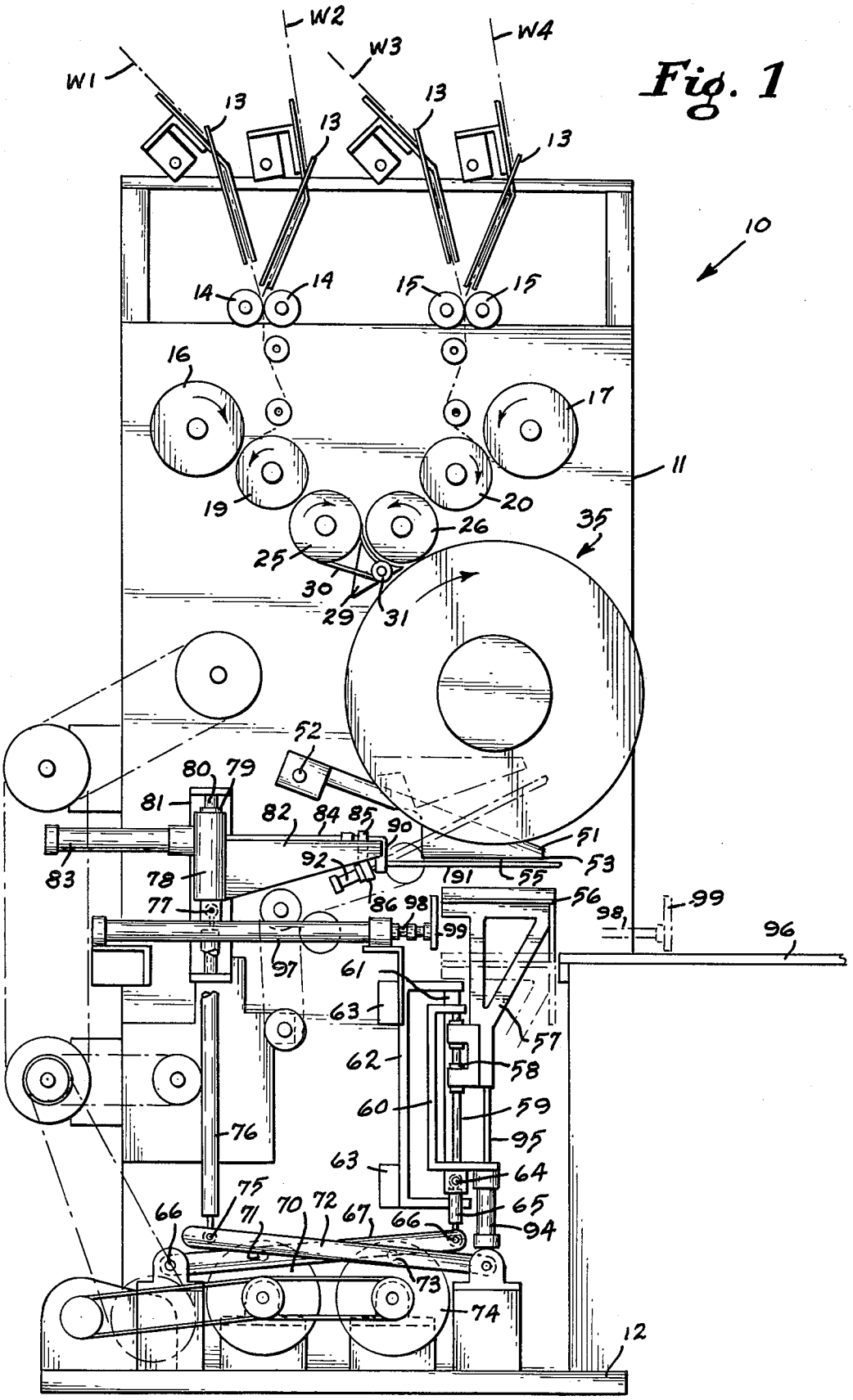
FIG. 1 is a side elevational view illustrating one embodiment of the invention.

With continued reference to the drawings, a machine 10 is provided having a main frame 11 mounted on a base 12. As illustrated, four webs W1, W2, W3, and W4, respectively, are fed to the machine 10 by unwind stands with suitable conventional tension and control systems, not shown. Normally, each web is of soft, rather flimsy, porous paper stock of the type used for facial tissue, paper napkins or the like. Also, each web may be of a width equal to the width of the product or may be relatively wide and passed through conventional slitters (not shown) before being introduced into the machine 10. In the present instance, each web is relatively wide and is slit into five individual lanes prior to introduction into the machine, however, any desired number of lanes may be provided. Since each lane of four webs are identical, only one lane will be described.

Each web W1 - W4 is fed to a folding apparatus such as a "C" fold former 13 carried by the main frame 11 where the webs are continuously folded into a desired configuration such as the "C" shaped in cross section. A first pair of webs W1 and W2 are discharged from the former 13 into the nip of a first pair of cooperating pull rolls 14 and a second pair of webs W3 and W4 are discharged into the nip of a second pair of pull rolls 15. Such pull rolls are driven from the main drive train of the machine 10 and are provided with either mechanical or automatic variable speed drive mechanisms which can set the amount of draw.

Figure 2:
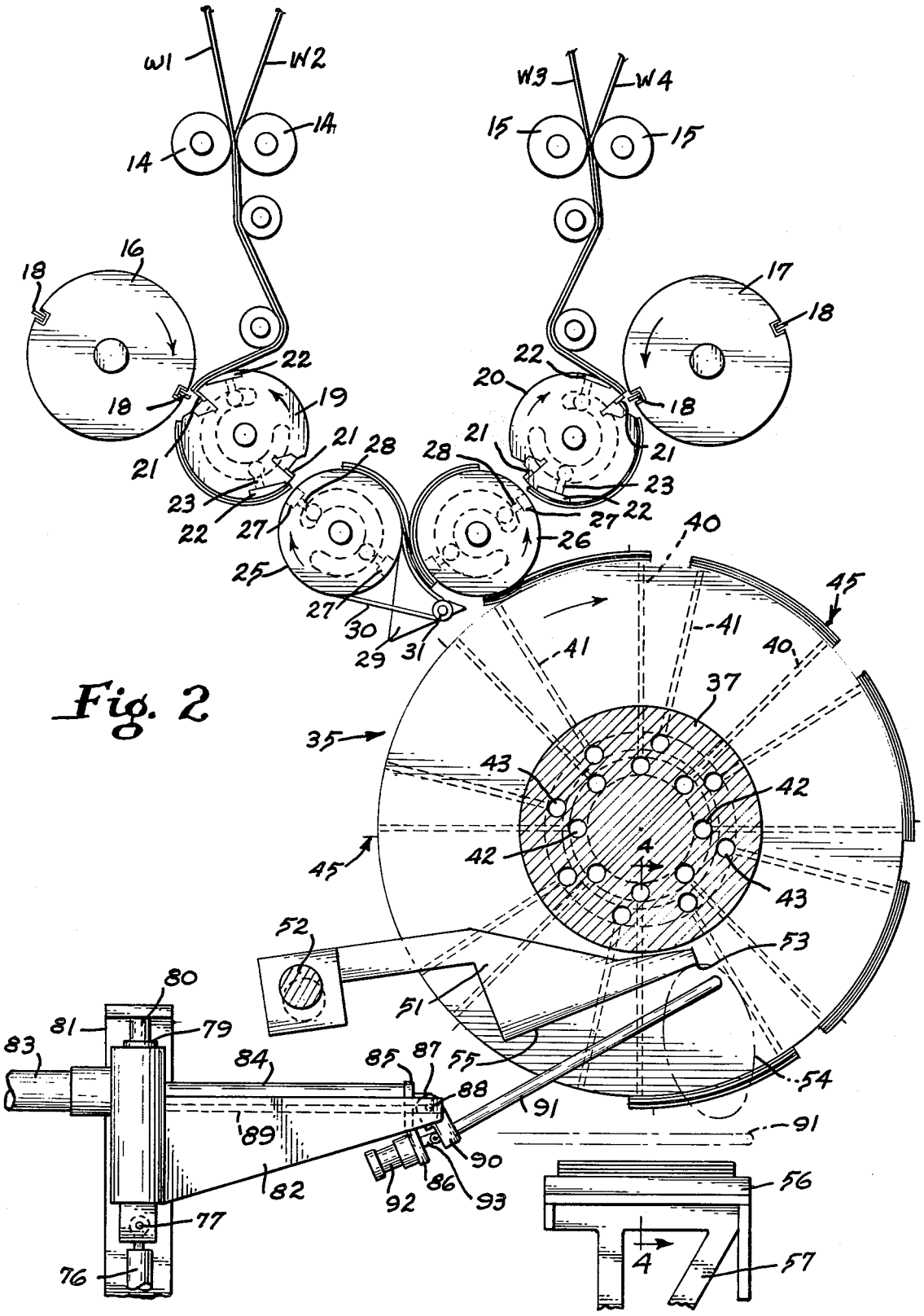
FIG. 2 is a fragmentary enlarged side elevational view of the feed mechanism of FIG. 1.

With particular reference to FIG. 2, a pair of spaced fly knife rolls 16 and 17 are mounted on the frame 11 below the pull rolls 14 and 15, respectively, and each of such fly knife rolls has a pair of diametrically opposed knives or cutting blades 18 extending radially outwardly from the periphery thereof. The fly knife rolls 16 and 17 are disposed contiguous to anvil rolls 19 and 20, respectively, in timed relationship with each other. Each of the anvil rolls 19 and 20 are provided with diametrically opposed anvils 21 which cooperate with the knives 18 of the rolls 16 and 17 to cut the first and second pairs of webs into individual segments of uniform length. It will be clear from the drawings that the first pair of webs W1 and W2 pass around idler rollers into the nip of the fly knife roll 16 and the anvil roll 19 and the second pair of webs W3 and W4 pass around idler rollers into the nip of the fly knife roll 17 and the anvil roll 20. In addition to the anvils 21, each anvil roll 19 and 20 is provided with a pair of opposed vacuum plates 22 located at the periphery thereof in spaced relationship with the anvils 21. Such vacuum plates communicate with a conventional source of vacuum through ports 23 and conventional shoe type valves (not shown) on each end of the anvil rolls.

It is desirable to create a space or gap between the web segments carried by the rolls 19 and 20 in order that they may be stripped from the packer roll 35 by the packer fingers 51 without interference with the next group of articles. In order to do this the rolls 16, 19 and 25 run at a faster speed than the pull rolls 14 and 15 are feeding the webs. The webs then slip back on the anvil roll vacuum plates 22 until they are cut off at which time they immediately travel at the surface speed of the anvil rolls 19 and 20. Due to the porosity of the material of the webs, the suction applied to the plates 22 is sufficient to retain both "C" shaped web segments in abutting relationship with each other while being moved by the anvil rolls.

A pair of transfer rolls 25 and 26 are mounted on the frame 11 in a position contiguous to and parallel with the anvil rolls 19 and 20 and such transfer rolls also are adjacent to and parallel with each other. Each of the transfer rolls has a pair of opposed vacuum grippers 27 which communicate with a source of negative pressure or vacuum through ports 28 and conventional shoe type valves (not shown) on each end of the transfer rolls. At the time that one of the grippers of a transfer roll is substantially in facing relationship with an anvil roll, vacuum is applied to the gripper and simultaneously vacuum is relieved on the vacuum plate of the anvil roll so that the web segments are transferred from the anvil roll to the associated transfer roll.

The transfer rolls 25 and 26 are in timed counterrotating relationship with each other with the result that the pair of web segments carried by the roll 25 mate with the pair of web segments carried by the roll 26 to form a group of four articles. In order to strip the pair of segments from the transfer roll 25, a guide plate 29 is disposed between the transfer rolls with the leading edge in substantially abutting relationship with the roll 25. If desired, a belt 30 which extends around a pulley 31 mounted on the guide plate 29 and a drive pulley (not shown) carried by the transfer roll 25, may be provided to positively strip the web segments W1 and W2 from the roll 25 and move such segments at the same speed and in abutting relationship with the segments W3 and W4 on the transfer roll 26. The belt 30 is particularly useful since the suction applied by the grippers 27 of the transfer roll 26 may not be sufficient to penetrate through the four web segments which are now carried by such transfer roll especially in a high speed operation.

Figure 3:
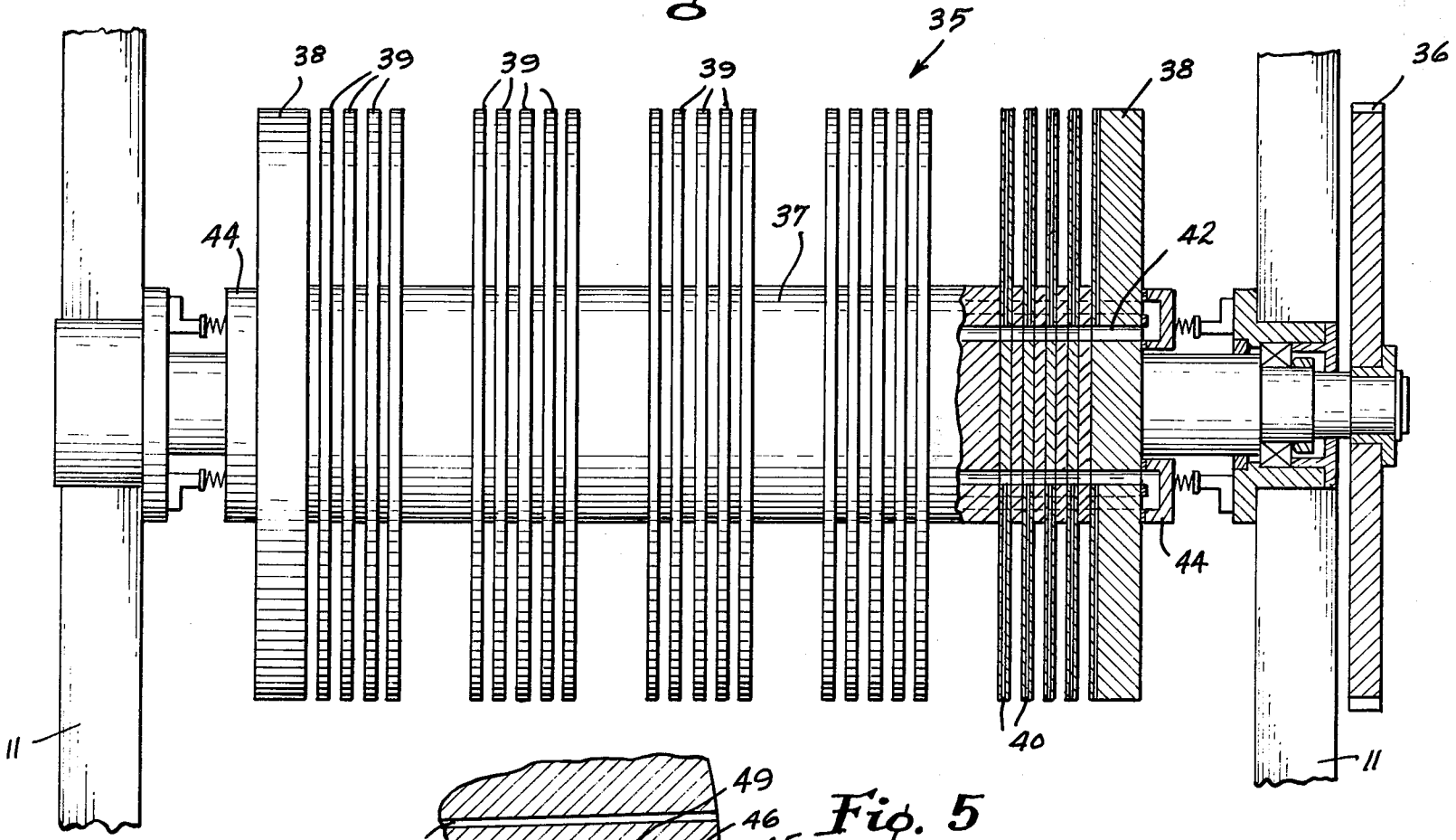
FIG. 3 is an enlarged front elevational view of the packer roll.

A packer roll 35 (shown best in FIGS. 2, 3 and 4) is mounted on the main frame 11 adjacent to and parallel with the transfer roll 26 and such packer roll is driven by a gear 36 located in the gear train (not shown) of the machine 10. The packer roll 35 includes a mandrel 37 connected to end plates 38 at each end and has a plurality of groups of disks 39 located intermediate such end plates. As illustrated, the packer roll 35 has five groups of disks in which the end groups include four disks 39 and an end plate 38 while the intermediate groups include five equally spaced disks 39 to accomodate five lanes of articles simultaneously. Each of the end plates 38 and disks 39 has a plurality of sets of vacuum holes or bores 40 and 41 extending radially outwardly from the mandrel 37. At the periphery of the packer roll, the vacuum holes of each set are spaced apart a distance less than the length of the web segments so that the holes 40 are disposed adjacent to the leading edge of the web segments and the holes 41 are disposed adjacent to the trailing edge thereof. The inner ends of the vacuum holes 40 and 41 communicate with vacuum ports 42 and 43, respectively, which in turn are connected to a conventional source of vacuum through shoe type valves 44 carried by each end plate.

Figure 5:
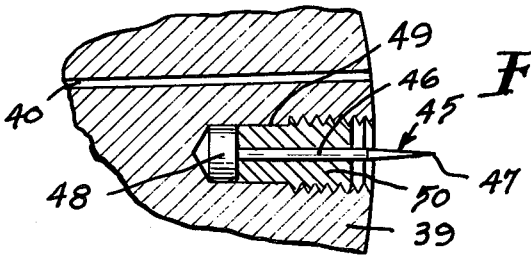
FIG. 5 is an enlarged sectional view taken on the line 5—5 of FIG. 4.
Figure 4:
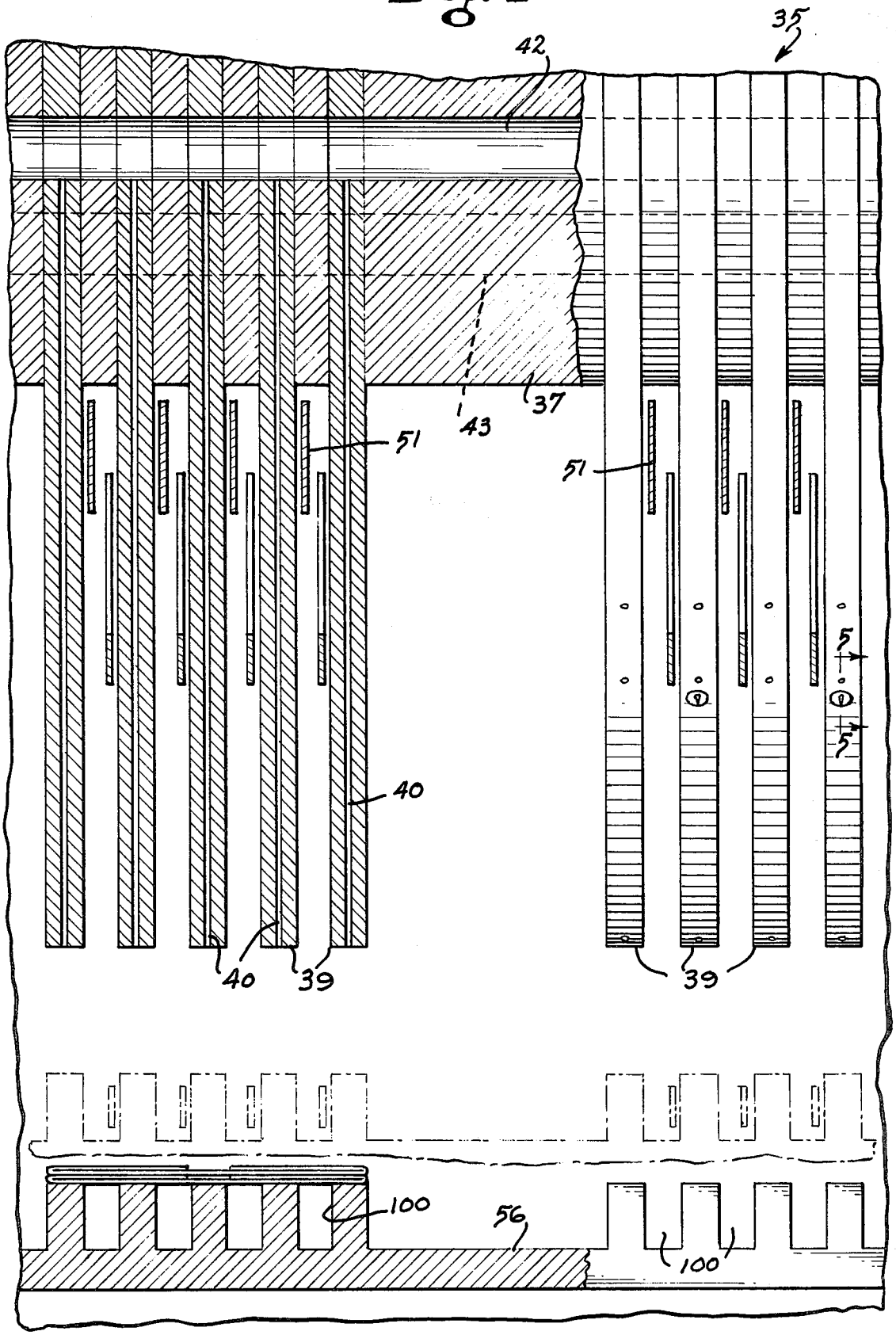
FIG. 4 is an enlarged fragmentary sectional view taken on the line 4—4 of FIG. 2.

As shown best in FIGS. 4 and 5, the vacuum applied through the holes 40 and 41 may not be sufficient to retain the outermost web segments on the packer roll during the high speed operation and, therefore, at least two of the disks 39 of each group is provided with a pin 45 located contiguous to the leading vacuum hole 40 and adapted to penetrate entirely through the web segments W1 - W4. Although it is apparent that the pins 45 could be mounted on the disks in any desired manner, each of such pins may include a shank 46 having a tapered point 47 at one end and a head 48 at the opposite end. The head is received within a threaded bore 49 in the disk and is secured in place by a threaded holder 50.

In order to remove the groups of segments or articles from the packer roll 35 and the pins 45 carried thereby, a plurality of packer fingers 51 are provided which are located intermediate the disks 39 of the packer roll. The packer fingers 51 are mounted on a conventional orbiting mechanism such as a crank 52 or the like in a manner such that the tip 53 of the fingers follow on orbital path 54 similar to that shown in dot-dash lines in FIG. 2. Of course, the orbiting packer fingers 51 are operated in timed relationship with the packer roll 35 so that the fingers complete eight orbits for each complete rotation of the packer roll. The orbiting path of the fingers 51 causes the lower edge 55 thereof to engage each sequential group of web segments carried by the packer roll and slide such groups of webs off of the pins 45 and discharge the same on to an elevator table 56 disposed below the packer roll. Initially, the elevator table 56 is positioned adjacent to the packer roll, however, as more and more groups of web segments are deposited on the table, such table is lowered from the packer roll to accomodate a stack of articles of a desired predetermined number, i.e., sufficient to fill a box of facial tissue.

With particular reference to FIG. 1, the elevator table 56 is fixed to a bracket 57 having bearings 58 that are slidably mounted on a shaft 59 which is carried by a carriage 60. Such carriage is slidably mounted on a shaft 61 carried by a support member 62 which is fixed to the main frame 11 by cross bars 63. The carriage 60 is connected by a pivot 64 to a link 65 and the opposite end of such link is connected by a pivot 66 to one end of a first lever arm 67. The opposite end of the lever arm 67 is pivotally mounted on the base 12 of the machine.

A cam 70 is supported by the base 12 and is provided with a cam track (not shown) which receives a cam follower 71 that is attached to the lever arm 67. As the cam 70 is driven in timed relationship with the packer roll 35, the carriage 60 and the elevator table 56 carried thereby are slowly lowered as the stack of tissues or web segments builds on the table until the desired number of articles have accumulated on the table 56.

A second lever arm 72 is pivotally mounted at one end on the base 12 and such second lever arm has a cam follower 73 which is cooperatively received within a cam track (not shown) of a cam 74. The cam 74 is mounted on the base 12 adjacent to the cam 70 and is driven in timed relationship therewith. The free end of the lever arm 72 is connected by a pivot 75 to one end of a link 76 the opposite end of which is connected by a pivot 77 to a movable support carriage 78. Such support carriage is provided with bearings 79 which slidably receive a shaft 80 carried by a fixed member 81 that is attached to the main frame 11. A pair of generally parallel arms 82 are secured to the carriage 78 and extend outwardly therefrom toward the elevator table 56.

A fluid cylinder 83 is carried by the movable support carriage 78 and has a piston rod 84 disposed between the arms 82. The outer free end of the piston rod 84 is attached to a plate 85 having an angularly disposed lower portion 86. A lug 87 extends outwardly from the plate 85 toward the elevator table 56 and carries a pivot pin 88 the opposite ends of which are slidably received within grooves 89 in the arms 82 to guide the free end of the piston rod and the members attached thereto. A block 90 is swingably mounted on the pivot pin 88 and such block carries a plurality of separation count fingers 91 which extend outwardly past the major portion of the elevator table 56. A fluid cylinder 92 is fixed to the angularly disposed lower portion 86 of the plate 85 and the piston rod 93 of the cylinder 92 is pivotally connected to the block 90 to control the movement of such block about the pivot pin 88.

As shown best in FIG. 2, the normal position for the separation count fingers 91 is between the disks 39 of the packer roll 35. However, when a predetermined number of facial tissues or other web segments have accumulated on the elevator table 56, the cylinder 92 is operated to retract the block 90 and cause the count fingers 91 to assume the position shown in phantom lines in FIG. 2 between the packer roll 35 and the elevator table 56. Any additional groups of tissues or web segments which are discharged from the packer roll 35 by the packer fingers 51 are retained on the count fingers 91.

When the count fingers have been interposed between the packer roll and the elevator table, a fluid cylinder 94 which is carried by the carriage 60 is operated to retract its piston rod 95. The free end of the piston rod 95 is attached to the lower portion of the elevator table 56 and causes the elevator table to drop until the upper surface is in alignment with a discharge table 96. A package discharge fluid cylinder 97 is fixed to the main frame 11 in a position substantially in alignment with the discharge table 96. The piston rod 98 of the cylinder 97 has a push plate 99 at its outer end so that when the elevator table 56 drops to the level of the discharge table 96, the cylinder 97 is operated to push the stack of tissues or web segments from the elevator table onto the discharge table. From the discharge table, the stack of counted tissues or web segments may be manually or automatically inserted into preformed wrappers, boxes, cartons, or other containers or such containers may be formed about the stack.

After the stack of articles have been placed on the discharge table 96, the fluid cylinder 97 retracts the push plate 99 to an inoperative position and the fluid cylinder 94 raises the elevator table 56. Thereafter, the cam 70 causes the lever arm 67 to raise the elevator table 56 to a position close to the packer roll 35. As the elevator table is being raised, the count fingers 91 are received within grooves 100 in the upper surface of the elevator table so that the elevator table lifts the few groups of tissue or web segments that have been accumulating on such fingers. When this occurs, the fluid cylinder 83 is operated to pull the count fingers 91 longitudinally from the grooves in the elevator table and then the fluid cylinder 92 is operated to pivot the block 90 to cause the count fingers to be raised to a position between the disks 39 of the packer roll. The cylinder 83 again is operated to extend the piston rod 84 and move the count fingers to the position shown in full lines in FIG. 2. With particular regard to FIG. 4, it is clear that both the packer fingers 51 and the count fingers 91 are located between the disks 39. If desired, a separator plate (not shown) may be located between such disks to remove any possibility of entanglement between such fingers.

It is noted that the webs W1–W4 may be embossed by one or more embossing rolls (not shown) prior to their introduction into the machine 10 or such webs may be plain. Also, the webs may be either white or any desired color and, if desired, the color of the individual webs may be of various colors to provide a multi-color package of paper products.

In the operation of the device, a plurality of webs W1–W4 of flexible, soft, porous material such as paper or the like are fed into the machine 10 where such webs are continuously folded into a desired cross-sectional configuration. Folded webs W1 and W2 are combined to form a first pair of webs that are directed along a first path and webs W3 and W4 are combined to form a second pair of webs that are directed along a second path. Each pair of webs is fed into the nip of an anvil roll 19 or 20 and a fly knife roll 16 or 17, respectively, where such webs are cut into segments of predetermined length. The pairs of webs are slidably held on the anvil rolls in such a manner that the one pair of web segments is separated lengthwise from a succeeding pair of segments.

The first and second paths terminate at a pair of cooperating transfer rolls 25 and 26 which strip the first and second pairs of web segments from the anvil rolls 19 and 20 and combine such pairs together to form a group of four folded web segments. The group of web segments are transferred to a packer roll 35 where the groups are held by vacuum and by outwardly extending pins 45 as such packer roll is rotated to advance the groups of webs. At the lower portion of the packer roll 35, a plurality of packer fingers are oscillated in an orbital path to strip sequential groups of webs from the packer roll and the pins 45 and discharge such groups in superposed position on an elevator table 56. The elevator table is lowered as the groups of web segments are placed onto the stack so that the top of the stack of superposed web segments remains a substantially constant distance below the packer roll.

When a desired number of groups of web segments have been placed in the stack on the elevator table, a plurality of count fingers 91 are interposed between the stack and the packer roll so that subsequent groups of web segments are received on the count fingers. At this time, the elevator table is lowered so that the upper surface is substantially level with the upper surface of a discharge table 96 and the stack of web segments is pushed off of the elevator table onto the discharge table from which the web segments are placed in boxes, cartons, and the like. Thereafter, the elevator table is raised to lift the segments which have accumulated on the count fingers and the count fingers are returned to inactive position.

The parts can be made of any suitable material and in different shapes or sizes as desired or required.

The present invention includes the folding, cutting, packing (stacking), separation and transfer of the material from a line similar to a combination of different types of napkin folders now used in the industry. Boxed facial is usually made from two plies of tissue at approximately 10 pounds per 3,000 square feet. However, a one ply sheet of equal weight will run just as well. The product is normally about 9 ½ inches in length (cut-off) by 8 ¼" wide, "C"-folded to approximately 4 ½ inches wide. It will be understood that the invention may include 4 to 5 webs wide but is not limited to any particular number.

With further reference to the boxed "C"-fold facial, the present invention relates to a method of converting tissue into what is referred to in the industry as boxed "C"-fold facial. Prior to this development, all "C"-fold tissue was converted on multiple unwind machines similar to those in U.S. Pat. Nos. 3,980,289 and 3,536,317. This involved unwinding the same number of rolls of tissue as the number of products in the individual carton. For example, if a 200 count box of tissue was required, 200 rolls of tissues were unwound, folded, and progressively placed on top of each other and log samed into carton size.

It is to be understood that the present invention can also be used to produce paper napkins and the like.

This type of machine has large output potential, but also requires many people to operate, a large capital investment, a large floor space requirement and logistics problem for mixing cases of different colored cartons of finished product.

With this invention, the product can be produced in smaller quantities and less capital investment, minimal floor space, minimum people, and several different machines can run different colored products and immediately fill multiple colored cases. The logistics of machine manning and color sorting is much more attractive.

The apparatus or machine of the present invention may consist of four unwind stands with suitable frames, bearings and tension control systems to feed the sheets to a "C" fold former, over an idler roll.

The machine may be a five line wide machine although different width machines can be utilized. A suitable means of slitting the four unwinding webs into five individual lanes is incorporated prior to the "C"-fold formers. Neither the unwinds or slitters are shown as there are many ways of accomplishing this with many different types of available technology.

The plurality of webs are illustrated in the drawings. The "C"-fold formers are shown and are supported by an appropriate structure which is attached to a frame which is attached to the main side frame of the machine. There is provided a base plate for the above framework.

Two sets of pull rolls are found to work best with two webs passing through each set of pull rolls. These pull rolls are driven from the main machine drive train with an appropriate mechanical variable speed drive which can set the amount of draw and have it remain fixed until a further manual adjustment is required.

In the main frame there is mounted two fly knife rolls with a pair of fly knives. These cut or sever the webs into individual articles. The fly knives cut against a pair of anvils in the rolls. These operate the same as shown and described in a previous Bretting patent.

The anvil rolls have a vacuum plate and the rolls are oversize which forces the sheets to slip back on the anvil rolls until they are cut. The vacuum is supplied through a port on their respective rolls. The vacuum is furnished to the ports through a shoe type valve on each end of the rolls as in the previous Bretting interfolder overlap patent.

Vacuum is also supplied to transfer rolls through ports which are also furnished with appropriate shoe type valves. The transfer rolls combine two "C"-fold tissues from each set of cut-off rolls and four tissues to packer roll at nip point of roll and packer roll. An appropriate guide aids the delivery of the four tissues.

Vacuum is used to hold the four tissues at the leading edge through vacuum holes and the trailing edge through vacuum holes. The vacuum holes are supplied vacuum through port holes which are furnished through an appropriate shoe type valve. Slugs control the start of the vacuum and slugs control the vacuum shut off in the shoe valves.

Further, at high speeds the outside tissue of the group of tissues may sometimes be lost due to the vacuum not being able to penetrate the other tissues due to the porosity of the tissue. To insure that this tissue is not lost, two pins on the leading edge of the tissue penetrate all four tissues at the nip between the rolls. There are clearance holes for the pins in the transfer roll.

In addition, the tissues are slipped backwards on the anvil rolls to create a space between the tissues so that they can be stripped from the roll by the orbiting packer fingers which are shown in the drawings and the tips of which travel through the path designated. There are four packer fingers per lane of tissues which orbit in the grooves as shown in the drawings of the packer roll.

Further, the four tissues are packed off the bottom of the packer roll by the packer finger onto the elevator table while the four separation-count fingers are in the proper position.

Also, the elevator drops as the package of tissues builds through the lever arms which is controlled by the box cam and cam follower fixed to the arm. The box cams are mounted on the cross shaft and pillow block bearings and base spacer. The cam shaft is driven through the chain sprocket and there is provided an appropriate roller chain and sprocket. Therefore, the sprocket is on the output shaft of the gear reducer.

The input to the reducer is from the sprocket, and the chain and compound sprockets which are all on a jack shaft with bearings. The sprocket is chain driven from a suitable sprocket mounted on the shaft and bearings. This sprocket is driven from the main machine drive shaft and proper sprocket.

In addition, the drive shaft also drives all the rolls in the machine through gears in their proper timing relationship.

The elevator table top is fastened to the structure which has slide bearings which slide on rods which are fixed to the structure. The structure moves up and down on the slide rods and bearings. The slide rods are fixed to the machine main frame through cross members and frame. An arm drives the structure through rod end bearings and brackets.

Further, the elevator drops on the box cam through the lever until the proper count is reached. At that time, the separation-count fingers which are in position are snapped out and the package starts to build on the fingers. At this time, the table is dropped to a desired position by the air cylinder.

At this time, the air cylinder pushes the ejection plate to a proper position which ejects stacks of counted tissues from the folder where they can be manually or automatically put into cartons.

Then, after ejection plate returns, the box cam and the air cylinder return the elevator to its upper position where the count fingers fit into grooves in the elevator. At this time, the count fingers withdraw by the cylinder through the cam track and the follower, leaving the new started stock of tissues on the elevator which now starts in the down slow speed by the cam.

Further, the count fingers then reset in the up position and enter back into the grooves in the packer roll. As the packer fingers and count fingers are rather long and flexible, they are separated by a guide in each groove in the packer roll.

The count fingers go to their up position through the drive link, arm, and box cam.

While several embodiments of the present invention have been illustrated herein in particular detail, it will be understood that variations and modifications may be effected without departing from the spirit and scope of the novel concepts of this invention.

What is claimed:

1. An apparatus for continuously folding, combining, and stacking a plurality of webs of flexible material comprising a frame, folding means on said frame for folding a plurality of webs of flexible material to a desired cross-sectional configuration, first pull roll means for combining first and second folded webs and directing the same along a first path, second pull roll means for combining third and fourth folded webs and directing the same along a second path, anvil roll means and cooperating cutting means disposed along each path for cutting said webs into segments of predetermined length, a pair of transfer rolls having means for stripping the segments from said anvil rolls, said transfer rolls cooperating with each other to combine the first and second segments of said first path with the third and fourth segments of said second path to form a group of segments, packer roll means having means for stripping said group of segments from said transfer rolls, and means for discharging said group of segments from said packer roll means to form a generally vertical stack of superposed segments.

2. The folding, combining, and stacking apparatus of claim 1 including vacuum operated means on said packer roll means for removing said group of segments from said transfer rolls.

3. The folding, combining, and stacking apparatus of claim 2 including pin means carried by said packer roll means to assist in holding said group of segments on said packer roll means.

4. The folding, combining, and stacking apparatus of claim 1 including table means located below said packer roll means for receiving said group of segments from said packer roll means, and said means for discharging said group of segments from said packer roll means includes a plurality of packer fingers.

5. The folding, combining, and stacking apparatus of claim 4 including means for lowering said table means as the stack of superposed segments build thereon, means for discharging the stack of segments from said table means after a predetermined number of segments have accumulated in the stack, and means for raising said table means when the stack of segments have been discharged therefrom.

6. The folding, combining, and stacking apparatus of claim 1 in which said packer roll means includes a pair of end members having disk means equally spaced therebetween, and at least certain of said end members and disk means having a plurality of radially disposed vacuum holes communicating with a source of vacuum.

7. The folding, combining, and stacking apparatus of claim 1 in which said folding means folds each of said webs to a "C" shaped cross-sectional configuration.

* * * * *